United States Patent [19]

Ichinose

[11] 4,063,503

[45] Dec. 20, 1977

[54] AUTOMATIC SCREEN PRINTING MACHINE

[76] Inventor: Shiro Ichinose, 11-8, 4-chome, Shinohara, Kobe, Japan

[21] Appl. No.: 695,393

[22] Filed: June 14, 1976

[51] Int. Cl.[2] ..... B41F 15/08; B41F 15/46

[52] U.S. Cl. ..... 101/123; 101/126

[58] Field of Search ..... 101/115, 116, 123, 124, 101/126, 129

[56] References Cited

U.S. PATENT DOCUMENTS

| | | | |
|---|---|---|---|
| 3,357,350 | 12/1967 | Jaffa et al. | 101/123 |
| 3,955,501 | 5/1976 | Bubley et al. | 101/123 |

FOREIGN PATENT DOCUMENTS

| | | | |
|---|---|---|---|
| 559,629 | 3/1975 | Switzerland | 101/115 |

*Primary Examiner*—Edgar S. Burr
*Assistant Examiner*—R. E. Suter
*Attorney, Agent, or Firm*—Sherman & Shalloway

[57] ABSTRACT

An automatic screen printing machine is disclosed in which a squeegee and doctor blade are synchronized with the vertical position of a reciprocating receiving roller carried by a lifting frame. The squeegee and doctor blade are positioned by rack gears on a common support mounted for reciprocation on a fixed longitudinal frame and driven by a mutual pinion which is operated by a link arm extended from the pressure roller.

1 Claim, 4 Drawing Figures

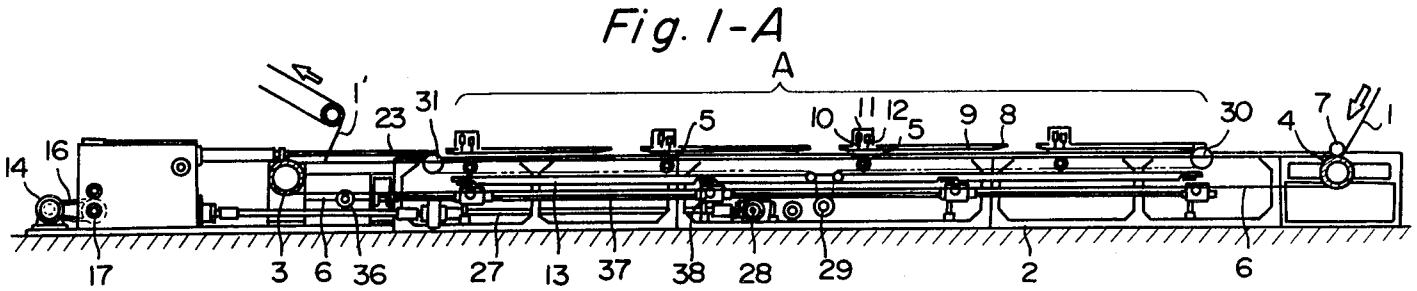
Fig. 1-A
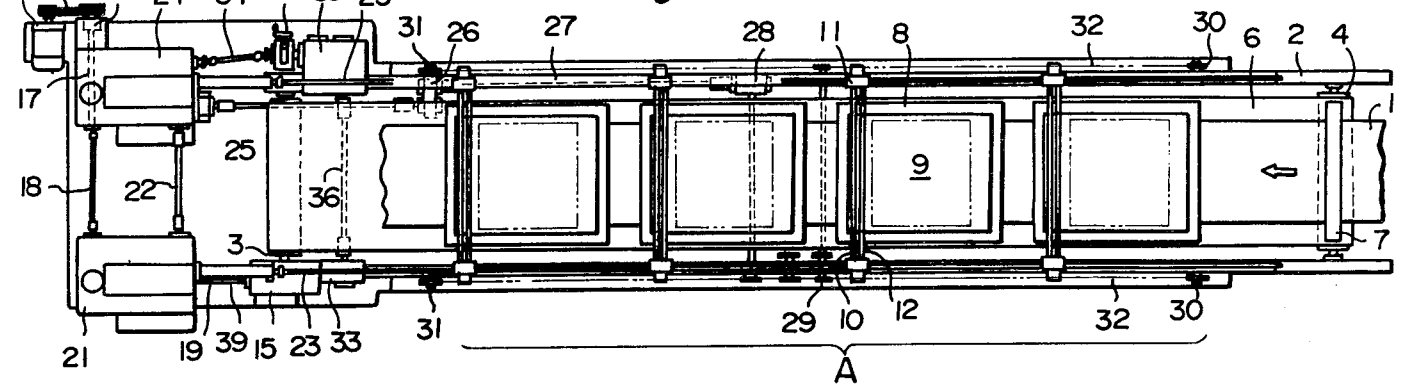
Fig. 1-B

Fig. 2-A
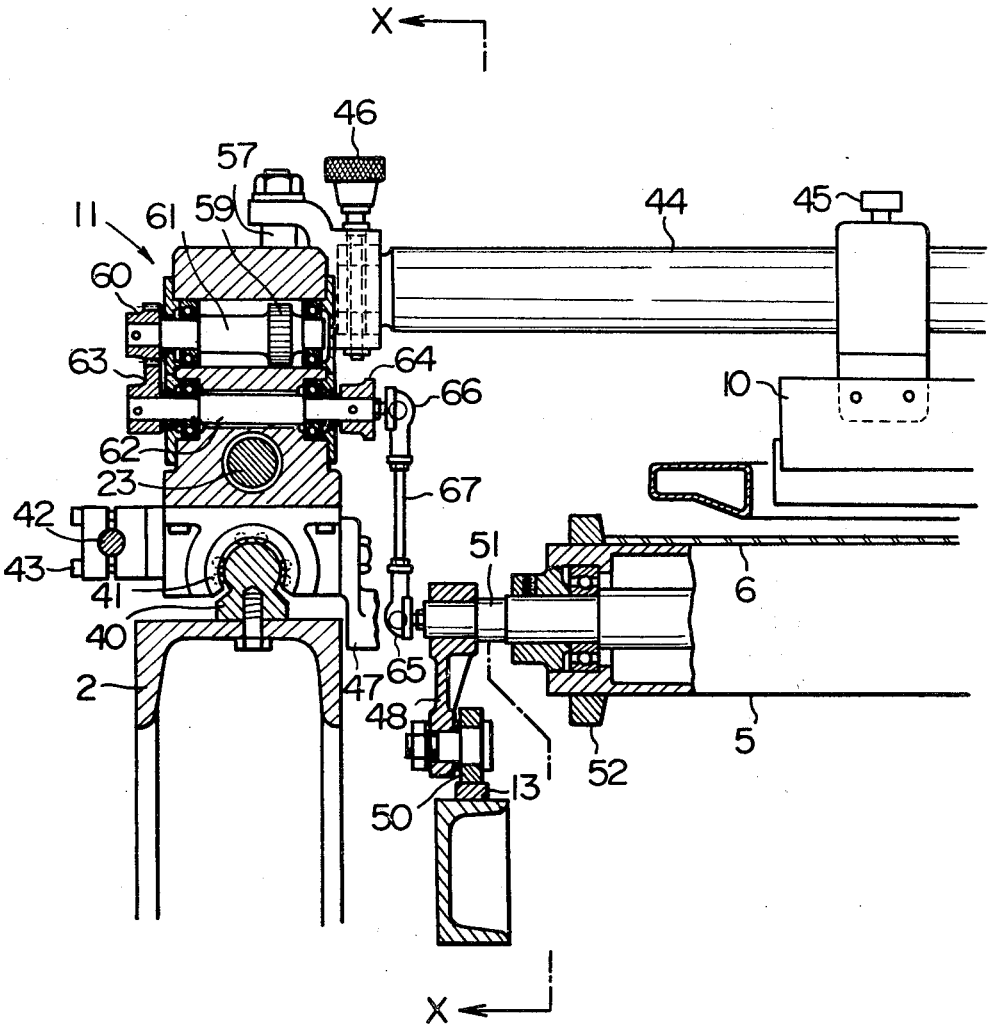

Fig. 2-B
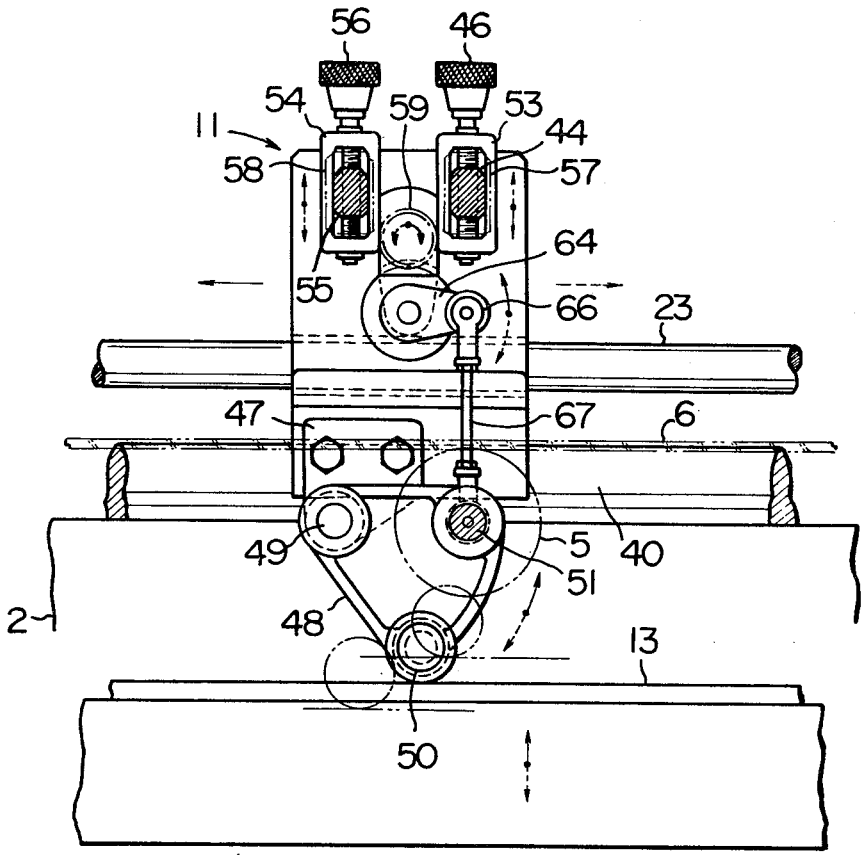

AUTOMATIC SCREEN PRINTING MACHINE

This invention relates to an automatic screen printing machine. More particularly, the invention relates to an automatic screen printing machine in which a material to be printed, such as paper and cloth, is continuously fed at a constant speed and the material is printed through a flat screen.

In the instant specification, the word "printing" is used to mean not only ordinary printing of papers, films and the like but also dye printing of fabrics, cloths and the like.

In conventional automatic printing machines using flat screens, an endless belt for supporting and transporting a material to be printed, such as cloth, is fed intermittently and while the endless belt is stopped, a screen is brought down on the material to be printed, and then, a squeegee member is scanned on the screen to squeeze out a printing paste on the material to be printed and the screen and squeegee member are lifted up and the endless belt is fed again.

In this conventional printing method, problems are involved in intermittent feeding of a material to be printed. For example, in order to register the material to be printed exactly with the screen, it is necessary to use an expensive printing belt (blanket) which has a much reduced tendency to elongate and a belt-stopping mechanism having a very high accuracy, and therefore, the structure of the printing machine is inevitably complicated and its price is very high. Further, when a flexible material is printed, an accurate pattern can hardly be printed because of a tension given when it is transported.

Recently, as a printing method overcoming the foregoing disadvantages, there has been proposed an automatic screen printing method comprising feeding continuously a material to be printed at a constant speed in the longitudinal direction by means of a transporting member, bringing down a printing stencil (screen), which has been positioned above the material to be printed, on the material to be printed to contact the stencil with the material to be printed, moving both the printing stencil and the material to be printed at the same speed in the same direction, squeezing out a printing paste on the material to be printed while the printing stencil travels along a length corresponding to about 1/2 of the pattern length, lifting up the printing stencil to release its contact with the material to be printed, moving the printing stencil in the reverse direction, and repeating the foregoing operations (see the specification of U.S. Pat. No. 3,168,036).

This automatic printing method is characterized in that a printing operation can be performed while a material to be printed is fed continuously at a constant speed, but the actual working of this printing involves various difficulties. For example, according to this automatic screen printing method, the operation of moving the printing stencil at the same speed in the same direction as the material to be printed during the printing step; the operation of moving the printing stencil in the reverse direction after the printing step; the operation of scanning the squeegee member on the stencil; the operation of contacting the material to be printed with the stencil at the start of the printing step; the operation of separating the material from the stencil at the completion of the printing step and the operation of moving continuously the material to be printed at such a rate that it is moved along a distance corresponding to one repeat length while one cycle of the printing operation is accomplished must be conducted so that the positions of the respective members are made exactly in accord with one another for every repeat of a pattern to be printed, and timings of these operations must be exactly controlled according to a strictly set program; otherwise, a printed material having a precisely registered printed pattern cannot be obtained at all.

In general, it is very difficult to perform two independent movements, namely the horizontal reciprocative movement of the stencil (screen) and the squeegee and the relative vertical movement of the stencil and the material to be printed, at good timings according to strictly controlled programs of both the times and positions.

A hydraulic cylinder or the like has heretofore been used as a lifting device in an automatic flat screen printing machine, and various limit switches or photoelectric switches have been used for control of positions. According to such fluid driving or electric control system, however, great deviations are caused in speeds of vertical movements or times for the start or completion of operations, and therefore, it is very difficult to perform operations for vertical movements precisely according to a strictly controlled program and to make these operations for vertical movements exactly synchronize with operations for other movements in the printing machine.

It is therefore a primary object of the present invention to provide an automatic, flat-screen, printing machine in which the relative vertical movement of a stencil and a material to be printed can be performed in proper synchronization with the horizontal reciprocative movement of a squeegee member in the printing step.

In an automatic flat-screen printing machine, when a printed cloth is separated from the printing screen or stencil after the completion of the printing step, the stencil springs up because of its elasticity and scatters the printing paste or ink which has adhered to the stencil, resulting in contamination of the printed cloth.

Another object of the present invention is, therefore, to provide an automatic flat-screen printing machine in which the area of contact between the screen and the material to be printed is substantially restricted to the area of contact between the squeegee member and the screen and hence, even if the material is separated from the screen at a high speed, the problem of scattering of the printing paste or ink is not encountered brought about at all.

In an automatic flat-screen printing machine of the above type where a material to be printed is continuously fed, since the printing operation is carried out only when the squeegee member is moved in one direction, it is necessary to return the printing ink or paste to the end where the printing operation starts, while the squeegee member is making its return travel.

Still another object of the present invention is to provide an automatic flat screen printing machine in which the operation of exchanging the squeegee member with the doctor blades for returning the printing ink or paste to the printing-starting position, is performed synchrously with the relative vertical movement between screen and the material to be printed.

In accordance with the present invention, there is provided an automatic screen printing machine comprising a transporting mechanism for supporting thereon a material to be printed and transporting it at a constant speed to a printing operation zone, a flat screen disposed above a running passage for the material to be printed in the printing operation zone, a squeegee member disposed above said flat screen to squeeze out a printing paste or ink onto the material to be printed through said flat screen, a receiving roller disposed below the running passage, a screen driving mechanism for reciprocating said flat screen along the running passage and synchronizing the speed and direction of said screen with those of the material to be printed at the printing step, a squeegee driving mechanism for reciprocating a mechanism supporting said squeegee member along the running passage for the material to be printed and making the moving direction of said squeegee member reverse to that of the material to be printed, and a lifting mechanism for lifting up said receiving roller to cause the material to be printed to contact said flat screen at the printing step and lowering the receiving roller to separate the material from said flat screen during the non-printing period, wherein said lifting mechanism comprises a rail capable of vertical movement between an elevated position and a lowered position and a lifting roller capable of horizontal movement along said rail; a lever is disposed on said squeegee member supporting mechanism so that it can swing and said receiving roller and said lifting roller are rotatably mounted on said lever; and said lifting rail, said lifting roller and said receiving roller are positioned relative to each other so that when said lifting rail is moved vertically, the lifting roller is caused to make a swinging movement to move the receiving roller vertically and when the lifting roller makes a reciprocative movement along the lifting rail, said receiving roller is guided in the horizontal direction and moved reciprocally along the rail.

This invention will now be described in detail by reference to the accompanying drawings, in which:

FIG. 1-A is a side view showing the arrangement of an automatic screen printing machine of the present invention;

FIG. 1-B is a plan view showing the machine of FIG. 1-A;

FIG. 2-A is a sectional view of a squeegee supporting device and a receiving roller supporting device; seen in a direction rectangular to the direction of advance; and FIG. 2-B shows the section taken along the line X—X in FIG. 2-A.

Referring to FIGS. 1-A and 1-B showing the entire arrangement of an embodiment of the printing machine of this invention, a mechanism for supporting and transporting a material 1 to be printed comprises a driving roller 3 and a driven roller 4 disposed on a machine frame 2 on both the sides of a plurality of printing zones A each having a, receiving roller 5, and an endless belt 6 supported and continuously driven by said driving, driven and receiving rollers 4, 5 and 6. A paste or other adhesive is applied to this endless belt 6 by a suitable pasting mechanism (not shown), and the material 1 to be printed is applied to the supporting surface of the endless belt 6 by a pasting roller 7 and fed to the printing zones A continuously at a constant speed. The printed material 1' is peeled from the endless belt 6 and fed to a winding reel or post treatment step (not shown).

The printing method of the present invention can be applied to printing of ordinary fabrics and cloths and screen printing of papers, films, metal foils and metal sheets. When a highly flexible material such as a fabric or cloth is printed, a supporting and transporting member such as an endless belt is used and the printing operation is conducted while the material to be printed is applied or pasted to this supporting and transporting member, or a continuous paper sheet is used as the supporting and transporting member instead of the endless belt, the fabric or cloth is pasted to the continuous paper sheet and the printing operation is conducted while the assembly of the paper sheet and the fabric or cloth is being continuously fed. When a material having a relatively low flexibility, such as a paper, a film, a metal foil, a laminate thereof or a metal sheet, is printed, if a suitable tension adjusting mechanism is disposed on the side of a feed reel or winding reel of the material, provision of a supporting and transporting member such as an endless belt can be omitted.

In the printing zones A, flat screens 9 are supported on screen frames 8 above the running passage for the material 1 to be printed, namely above the upper portion of the endless belt 6. The number of the screens 9 corresponds to the number of colors of a pattern to be printed. The screen frame 8 is supported on the machine frame 2 so that it can make a reciprocative movement in the horizontal direction along the endless belt 6 and during the printing operation, the screen frame 8 is driven at the same speed in the same direction as the material 1 to be printed by a screen-driving mechanism detailed hereinafter. After the printing operation, the screen frame 8 is driven in a direction reverse to the direction of the movement of the material 1.

Above the flat screen 9 there is disposed a squeegee member 10 supported on a squeegee supporting mechanism 11 to squeeze out a printing paste or ink (not shown) onto the material 1 to be printed. This squeegee supporting mechanism 11 is supported on the machine frame 2 so that it can make a reciprocative movement in the horizontal direction along the endless belt 6. During the printing operation, the squeegee supporting mechanism 11 causes the squeegee member 10 to make a scanning movement from one end to the other end of the flat screen 9, whereby printing of the material 1 can be accomplished. A doctor blade 12 is mounted on the squeegee supporting mechanism 11 to return the printing paste or ink to the printing-starting end of the screen after the printing operation.

In order to contact the material 1 on the endless belt 6 with the flat screen 9 for the printing operation and to release this contact during the period where the printing operation is not conducted (hereinafter referred to as "the non-printing period"), the flat screen 9 and a part of the supporting and transporting mechanism, for example, the receiving roller 5, are arranged so that they can make relative vertical movements. In the embodiment shown in FIGS. 1-A and 1-B, a pair of the squeegee member 10 and the corresponding receiving roller 5 with the endless belt 6 interposed therebetween are arranged so that they can make a reciprocative movement in the horizontal direction. During the printing operation, the receiving roller 5 is located at an elevated position to contact the material 1 with the printing screen. During the non-printing period, the receiving roller 5 is located at a lowered position to release the contact between the material 1 and the printing screen. A lifting rail 13 is disposed both to to reciprocate the receiving roller 5 in the horizontal direction and to raise and lower the receiving roller 5 in the vertical direction. The position of the lifting rail 13 is controlled by a lifting device detailed hereinafter, and the receiving roller 5 is moved vertically with the vertical movement of this lifting rail 13.

By reciprocating the flat screen 9 on one horizontal plane, scanning a pair of the squeegee member 10 and receiving roller 5 on the flat screen 9 and moving up and down the receiving roller 5 in the vertical direction as illustrated in FIGS. 1-A and 1-B, the material 1 to be printed can be registered exactly with the flat screen 9, and a deviation of a pattern at successive printing zones can be remarkably reduced. In the conventional printing method using a flat screen, when the screen contacted with the material to be printed throughout the surface thereof is separated from the material at the completion of the printing operation, there is caused an undesirable phenomenon of scattering of a printing paste or ink from the printing screen. In the embodiment of the present invention shown in FIGS. 1-A and 1-B, the part of the screen to be contacted with the material 1 is restricted to the narrow, transverse region gripped between the squeegee member and the receiving roller. Even when the screen is separated from the material 1 at a high speed at the completion of the printing operation, scattering of the printing paste or ink can be effectively prevented.

The printing operation using the printing machine shown in FIGS. 1 and 2 will now be described.

The material 1 to be printed is pasted on the surface of the endless belt 6 by the pasting roller 7, and the material 1 is supported and fed continuously at a constant speed in a certain direction (to the left in the drawings) into the printing zones A by the endless belt 6. At the start of the printing operation, the flat screen 9 is moved in the same direction (to the left) as the moving direction of the material 1 and at the same speed. At this moment, the squeegee member 10 is located at one end of the screen 9 (the left end in the drawings). The receiving roller 5 is lifted up to the uppermost position just after the completion of aceleration of the screen 9 to cause the material on the endless belt 6 to come in contact with the screen 9. In this state, the squeegee member 10 is paired with the receiving roller 5 and they are moved in a direction (to the right in the drawings) reverse to the moving direction of the material 1 to perform printing on the moving material 1 through the screen 9.

Just before the squeegee member 10 arrives at the other end (the right end in the drawings) of the screen 9, the printing operation is completed, and the lifting rail 13 is lowered and in turn, the receiving roller 5 is lowered, whereby the contact of the material 1 with the flat screen 9 is released. The advance of the flat screen 9 is stopped and the screen 9 is then moved in a direction (to the right in the drawings) reverse to the moving direction of the material 1. The squeegee member held by the squeegee supporting mechanism 11 is then replaced by the doctor blade 12 and the squeegee supporting mechanism 11 is moved in the same direction as the moving direction of the material 1, whereby the remaining supply of ink or paste on the screen 9 is returned to the printing-starting end. With this movement of the squeegee supporting mechanism 11, the receiving roller 5 is moved in the same direction as the moving direction of the material 1 at the lowered position thereof.

When the squeegee supporting mechanism 11 arrives at one end (the left end in the drawings) of the screen, the return course movements of the flat screen 9 and the pair of the squeegee member and the receiving roller are stopped. In this state, the doctor blade 12 is interchanged with the squeegee member 10; the receiving roller 5 is lifted up, and the printing course movement of the screen 9 and squeegee member 10 is started. Thus, the foregoing operations are continuously repeated. In this automatic screen printing method of the present invention, during a period from the start of the printing operation to the start of the printing operation of the next cycle, the material 1 to be printed is moved by a distance corresponding to the length of one repeat or printing zone, and the material 1 can be printed in a continuous manner.

In the automatic screen printing machine of the present invention, it is preferred that the above-mentioned supporting and transporting means 3, 5 and 6, flat screen 9 and squeegee member 10 be driven by one common drive source and the operations of these members 3, 5, 6, 9 and 10 be performed according to a mechanically controlled program. More specifically, according to this driving system, the above-mentioned scanning reciprocative movements of the printing flat screen 9 and squeegee member 10 are always made synchronous with the feed speed of the supporting and transporting mechanism 6, whereby the printing operation can be performed at a high speed with a high printing accuracy in a continuous manner. When the above-mentioned scanning reciprocative movements of the printing flat screen 9 and squeegee member 10 are appropriately coordinated with such operations as acceleration, reduction and stopping and all the movements and operations are performed smoothly, no deviation is caused in timings for respective operations and movements and these timings can be set and adjusted with high accuracy very easily.

As the common drive source for driving the endless belt 6, the flat screen 9 and the squeegee supporting mechanism 11 and moving vertically the receiving roller 5, there is disposed a driving motor 14 on one end portion of the machine frame 2.

An endless belt driving device 15 for driving roller 3 at a constant speed is included. The driving power of the driving motor 14 is transmitted to a main shaft 17 through a V-belt 16 and then transmitted to the endless device 15 through a belt-driving connecting shaft 18 and an input shaft 19. The main shaft 17 is connected to the driving motor 14 through an electromagnetic clutch 20.

A screen driving device 21 is disposed to reciprocate the screen frame 8 in the horizontal direction. In this screen driving device 21, by a combined operation of a partially-toothed wheel and a cam, for example, the continuous one-way rotation of the main shaft 17 is converted to alternating normal-and reverse-rotations of a shaft 22 and then converted to the horizontal reciprocative movement of a screen-driving connecting rod 23 extending in the moving direction of the screen 9, namely along the endless belt, by a combination of a pinion and a rack. This screen-driving connecting rod 23 includes a plurality of screen frames 8 fixed thereto at prescribed intervals, and these screen frames 8 are reciprocated in the horizontal direction with the reciprocative movement of the connecting rod 23.

A squeegee-driving device 24 is disposed to reciprocate the squeegee supporting mechanism 11 in the horizontal direction. In this squeegee driving device 24, the continuous one-way rotation of the main shaft 17 is converted to alternating normal and reverse rotations of a shaft 25, by a partially-toothed wheel and a cam, for example, and the alternating normal and reverse rotations of the shaft 25 are transmitted to a squeegee driving sprocket through a series of power transmitting means such as a squeegee accelerating mechanism 26, a squeegee driving shaft 27 and a miter gear case 28. Idle wheels 30 and 31 are disposed on both the terminal portions of the reciprocative movement passage for the squeegee supporting mechanism 11, and a roller chain 32 is stretched among these idle wheels 30 and 31 and the squeegee driving sprocket 29. A plurality of squeegee-supporting mechanisms 11 are fixed to the roller chain 32 at suitable intervals through a suitable fixing mechanism (detailed hereinafter). In this arrangement, by the alternating normal and reverse rotations of the squeegee driving sprocket 29, each of the squeegee supporting mechanisms 11 is reciprocated in the horizontal direction.

Below each printing zone, a lifting device 33 is disposed to move up and down in the vertical direction the receiving roller supporting the endless belt 6. The continuous one-way rotation of the main shaft 17 is transmitted to this lifting device 33 through an output shaft 34 and a timing adjusting device 35. In this lifting device 33, the rotation of the main shaft 17 is converted to stopping of rotation of a lifting connecting shaft 36 for a prescribed period, intermittent rotation of the lifting connecting shaft 36 and intermittent reciprocative movement of a lifting connecting rod 37 by a combined operation of a partially-toothed wheel and a cam, for example. These operations of the connecting shaft 36 and connecting rod 37 are transmitted to the lifting rail 13 by a pinion-rack mechanism 38, whereby rising of the lifting rail 13 and the receiving roller 5; retention of the lifting rail 13 and receiving roller 5 at the elevated position; lowering of the lifting rail 13 and receiving roller 5 and retention of the lifting rail 13 and receiving roller 5 at the lowered position are performed.

Referring now to FIGS. 2-A and 2-B illustrating the squeegee member supporting mechanism and the receiving roller supporting mechanism, a guide rail 40 extending transversely of the machine is disposed above the machine frame 2, and the squeegee-member supporting mechanism 11 is mounted on the guide rail 40 through a slide bearing 41 so that the supporting mechanism 11 can make a reciprocative movement in the horizontal direction. A plurality of squeegee member supporting mechanisms 11 are fixed at prescribed intervals to a connecting rod 42 extending in parallel to the guide rail 40 by a suitable clamping mechanism 43 so that their positions can be finely and minutely adjusted. The squeegee member 10, for example, a squeegee doctor, is fixed to a squeegee holder 44 extending in a direction crossing the endless belt 6 by suitable clamping means 45. This squeegee holder 104 is attached to the squeegee member supporting mechanism 11 through pressure adjustment means such as a squeegee pressure adjustment screw 46.

One important feature of the present invention resides in that the receiving roller 5 for supporting the endless belt 6 is mounted so that it can make a vertical movement and a horizontal reciprocative movement together with the squeegee member supporting mechanism 11. Control of the position of the receiving roller 5 and the guide of the horizontal reciprocative movement of the receiving roller 5 are accomplished by mounting of a roller on the squeegee member supporting mechanism 11 so that the roller can follow and move along the rail 13. The vertical movement of the roller by the rail causes the receiving roller 5 to be vertically moved. The horizontal movement of the receiving roller 5 is accompanied by the motion of the roller capable of following the rail 13. The vertical movement of the receiving roller 5 thus is accomplished by the vertical movement of the rail 13, whereby the receiving roller 5 can be operated in synchronization with the above-mentioned respective operations for the printing. This feature will now be described.

Referring to FIGS. 2-A and 2-B again, a bracket 47 is disposed in the lower portion of the squeegee-supporting mechanism 11 and a lever 48 is hinged on the bracket 47 so that the hinged lever 48 can swing about the shaft 49. The lever 48 has a fan-like or triangular shape and includes a lifting roller 50 rotatably mounted in the lower corner of the lever 48 through a suitable bearing mechanism. In the other corner of the lever 48, namely in the portion above the line connecting the shaft 49 and the roller 50, a supporting shaft 51 for the receiving roller 5 is disposed, and the receiving roller 5 is rotatably mounted on this supporting shaft 51 through a bearing.

The shaft 49 connecting the lever 48 to the squeegee supporting mechanism 11 is preferably located at a position offset in the direction of the printing course ( toward the left in FIG. 2-B ) from the line connecting the receiving roller supporting shaft 51 and the shaft of the lifting roller 50. By this arrangement, the vertical movement of the receiving roller 5 during the printing course can be performed smoothly. For this purpose, the program is set so that the time for advance of each of the screen and squeegee member ( the time for the movement during the printing course ) is made longer than the time for retreat of the each of these members while the time for retention or stopping of the lifting rail at the uppermost position is made equal to the time for stopping of the lifting rail at the lowermost position. At the initial stage of the movement during the printing course the material to be printed is contacted with the screen and at the terminal stage of the movement during the printing course the material is separated from the screen. Guide rollers 52 are disposed on both the ends of the receiving roller 5 to regulate the transverse position of the endless belt. The lifting roller 50 remains in engagement with the lifting rail 13.

In the above-illustrated arrangement, when the squeegee supporting mechanism 11 is reciprocated along the guide rail 40 in the lengthwise direction of the machine frame, the lifting roller 50 rolls back and forth on the surface of the lifting rail 13 while carrying the receiving roller 5 and the endless belt 6 at the appropriate level. When the lifting rail 13 is lifted or lowered by the above-mentioned lifting device 33, the lever 48 is rotated in the counter-clockwise direction or clockwise direction, whereby the receiving roller 5 is lifted or lowered. When the receiving roller 5 is at the uppermost position, for the printing step, the flat screen 9, the material 1 to be printed and the endless belt 6 are gripped between the squeegee member 10 and the supporting face of the receiving roller 5.

According to another feature of the present invention, the squeegee member and the doctor blade are mounted on the squeegee member supporting mechanism so that the squeegee member and the doctor blade are vertically moved, alternately. The squeegee member and the doctor blade are interrelated with the vertical movement of the receiving roller so that when the receiving roller is at the elevated position, the squeegee member is at the lowered position and when the receiving roller is at the lowered position, the doctor blade is at the lowered position. By this arrangement, even when the screen and the squeegee member are reciprocated at relatively high speeds, the printing operation can be fully synchronized with regard to successive print steps. This feature will now be described.

Referring to FIG. 2-B, a squeegee holder attachment 53 and a doctor blade holder attachment 54 are mounted on the squeegee supporting mechanism 11 so that they can be vertically moved. The squeegee holder 44 is fixed to the attachment 53 so that its position in the vertical direction can be adjusted by the squeegee pressure adjusting screw 46, as described hereinbefore, and a doctor blade holder 55 is fixed to the attachment 54 so that its position in the vertical direction can be adjusted by a blade pressure adjusting screw 56. The squeegee attachment 53 is fixed to a rack gear 57 and the doctor blade attachment 54 is fixed to a rack gear 58. A pinion gear 59 engaged with these racks 57 and 58 is disposed in the interior of the supporting mechanism 11, and a spur gear 60 is fixed to the shaft 61 of the pinion 59. A shaft 62 is rotatably disposed in parallel to a shaft 61 of the pinion 59, and a fan-shaped segment gear 63 engaged with the spur gear 60 is fixed to the external end portion of the shaft 62, while a lever arm 64 is fixed to the internal end portion of the shaft 62.

A connecting rod 67 is coupled between the end of the receiving-roller supporting shaft 51 and the end of the lever arm 64 through ball joints 65 and 66, respectively. When the receiving roller 5 is lifted or lowered, the lever 64 is thus turned in the counter-clockwise or clockwise direction by a link 67. With such turning of the lever 64, the pinion 59 is rotated in the clockwise direction or the counter-clockwise direction, whereby the squeegee holder 44 is lowered and the doctor blade holder 55 is lifted, or the squeegee holder 44 is lifted and the doctor blade holder 55 is lowered.

Thus, with the vertical movement of the lifting rail 13, the vertical movement of the receiving roller 5 and the exchange of working position of the squeegee member 10 and the doctor blade 12 can be performed smoothly. More specifically, during the printing operation, the squeeging operation can be accomplished by the lower end of the squeegee member 10 and the receiving roller 5 while the screen 9 is contacted with the material 1 to be printed, and during the nonprinting period, the screen 9 is separated from the material 1 and the printing paste or ink on the screen 9 is returned.

In the embodiment specifically illustrated in FIGS. 2-A and 2-B, the pinion 59 is turned by the lever 64, and the vertical movements of the squeegee member 10 and the doctor blade 12 are performed directly mechanically. Even when the vertical movements of the squeegee member 10 and doctor blade 12 are performed by using, for example, a fluid mechanism such as an air cylinder and a change lever of the fluid mechanism is actuated by the lever 64, the exchange between the squeegee member 10 and the doctor blade 12 can be performed smoothly.

In the embodiment shown in FIGS. 2-A and 2-B, the connecting rod 23 extends through the squeegee supporting mechanism 11. The squeegee supporting mechanism 11 and connecting rod 23 are disposed so that they can make horizontal reciprocative movements independently from each other. In general, the squeegee supporting mechanism 11 and a supporting mechanism ( not shown ) for the screen frame 8 are supported on the common guide rail 40 so that they can make reciprocative movements, and the scanning reciprocative movement of the squeegee supporting mechanism 11 is restricted within a region of from one end to the other end of the moving screen 9 and both of said two supporting mechanisms are arranged so that collision is not caused between them.

The vertical movement of the lifting rail can be performed by a suitable lifting device. In the present invention, it is preferred that the vertical movement of the lifting rail 13 be performed according to a mechanically controlled program by using, for example, a pair of partially toothed wheels in combination with a lifting cam, as disclosed in my copending application Ser. No. 695,392, filed June 14, 1976.

As will be apparent from the foregoing illustration, in the present invention, there is attained a prominent advantage that by skillfully combining the operation of moving the receiving roller reciprocatively in the horizontal direction with the operation of moving the receiving roller in the vertical direction, a printed material having a precisely printed pattern can be obtained while the material to be printed is being continuously fed into the printing zone.

What I claimed is:

1. In an automatic screen printing machine printing zone including a constant speed conveyor, a flat screen over said conveyor, squeegee means including a squeegee blade over said screen, doctor means including a doctor blade over said screen, a receiving roller under said conveyor, and drive means including means for synchronized reciprocation of the receiving roller, squeegee means and doctor means and lifting means for lifting the receiving roller, the improvement comprising a common support member carrying said squeegee, doctor blade and receiving roller, said common support member being mounted for reciprocation on a fixed plane, a lever hinged on said common support member for rotation on an axis substantially parallel to said fixed plane, bearing means in said lever for mounting said receiving roller, said lifting means including a lift rail underlying a portion of said lever and in engagement therewith whereby said receiving roller is raised and lowered in relation to said fixed plane, means for alternately raising and lowering said squeegee and said doctor blade and including a squeegee rack, a doctor blade rack, a pinion gear in engagement with both said racks, and link means for rotating said pinion gear in unison with raising and lowering of said receiving roller to lower said squeegee when said receiving roller is lifted and to lower said doctor blade when said receiving roller is lowered.

* * * * *